US008980016B2

(12) United States Patent
Sato et al.

(10) Patent No.: US 8,980,016 B2
(45) Date of Patent: Mar. 17, 2015

(54) CHROMIUM-FREE SOLUTION FOR TREATING METAL SURFACES

(75) Inventors: Takaaki Sato, Kanagawa-ken (JP); Misa Suzuki, Kanagawa-ken (JP)

(73) Assignee: Nihon Hyomen Kagaku Kabushiki Kaisha, Tokyo (JP)

( * ) Notice: Subject to any disclaimer, the term of this patent is extended or adjusted under 35 U.S.C. 154(b) by 535 days.

(21) Appl. No.: 12/925,665

(22) Filed: Oct. 27, 2010

(65) Prior Publication Data

US 2011/0041958 A1 Feb. 24, 2011

Related U.S. Application Data

(62) Division of application No. 12/009,371, filed on Jan. 18, 2008, now abandoned.

(30) Foreign Application Priority Data

Jan. 19, 2007 (JP) ..... 2007-010321

(51) Int. Cl.

| | |
|---|---|
| ***C23C 22/56*** | (2006.01) |
| ***C23C 22/57*** | (2006.01) |
| ***C23C 22/40*** | (2006.01) |
| ***C23C 22/44*** | (2006.01) |
| ***C23C 22/46*** | (2006.01) |
| ***C23C 22/78*** | (2006.01) |

(52) U.S. Cl.

CPC ..... *C23C 22/44* (2013.01); *C23C 22/40* (2013.01); *C23C 22/46* (2013.01); *C23C 22/78* (2013.01); *Y10T 428/12729* (2015.01)

USPC ..... 148/275; 148/277; 148/285; 148/243

(58) Field of Classification Search

CPC ..... C23C 22/40; C23C 22/42; C23C 22/44; C23C 22/46; C23C 22/47

USPC ..... 148/243–263, 269–287

See application file for complete search history.

(56) References Cited

U.S. PATENT DOCUMENTS

| | | | | |
|---|---|---|---|---|
| 4,264,378 | A | 4/1981 | Oppen et al. | |
| 4,992,115 | A * | 2/1991 | Ikeda | 148/247 |
| 2003/0209293 | A1 | 11/2003 | Sako et al. | |
| 2003/0213533 | A1 * | 11/2003 | Sako et al. | 148/243 |

FOREIGN PATENT DOCUMENTS

| | | | | |
|---|---|---|---|---|
| EP | 0 015 020 | A1 | 9/1980 | |
| EP | 1 338 678 | A2 | 8/2003 | |
| EP | 1 489 199 | A1 | 12/2004 | |
| EP | 1 650 327 | A1 | 4/2006 | |
| JP | 07-084665 | * | 9/1995 | C23C 22/36 |
| JP | 2000-096255 | A | 4/2000 | |
| JP | 2002-012980 | A | 1/2002 | |
| JP | 2003-055777 | A | 2/2003 | |
| JP | 2004-510882 | A | 4/2004 | |
| JP | 2004-183015 | A | 7/2004 | |
| JP | 2004-232040 | A | 8/2004 | |
| JP | 2004-232047 | A | 8/2004 | |
| JP | 2005-048199 | A | 2/2005 | |
| JP | 2005-097733 | A | 4/2005 | |
| JP | 2005-520047 | A | 7/2005 | |
| JP | 2006-511698 | A | 4/2006 | |
| JP | 2006-152435 | * | 6/2006 | C23C 22/40 |
| WO | WO-01/42530 | A1 | 6/2001 | |
| WO | WO-02/28550 | | 4/2002 | |
| WO | WO-03/069024 | | 8/2003 | |
| WO | WO-03/069024 | A1 | 8/2003 | |
| WO | WO-03/078682 | | 9/2003 | |
| WO | WO-2006/137663 | A1 | 12/2006 | |

* cited by examiner

*Primary Examiner* — Lois Zheng

(74) *Attorney, Agent, or Firm* — Birch, Stewart, Kolasch & Birch, LLP

(57) ABSTRACT

An acidic chromium-free solution for treating a metal surface containing: a vanadium cation source and/or a vanadyl cation source; an organic acid as an anion source; and at least one oxoacid as another anion source is provided. The oxoacid is selected from oxoacids of nitrogen, sulfur, phosphorus, boron, and chlorine. A metal component composed of, for example, aluminum or magnesium is brought into contact with the chromium-free solution to form a vanadium coating film of a surface of the metal component. A surface treating process using this chromium-free solution is useful for formation of a coating film having low corrosion resistance and low electric resistance.

5 Claims, No Drawings

CHROMIUM-FREE SOLUTION FOR TREATING METAL SURFACES

CROSS-REFERENCE TO RELATED APPLICATIONS

This application is a divisional application of U.S. Ser. No. 12/009,371 filed Jan. 18, 2008, which in turn claims priority from Japanese Application No. 2007-10321 filed Jan. 19, 2007, the disclosures of which are herein incorporated by reference.

FIELD OF THE INVENTION

The present invention relates to a solution not containing environmentally hazardous chromium for forming a film having high corrosion resistance and low electrical resistance on a surface of a metallic component such as a magnesium or magnesium alloy component (hereinafter collectively referred to as "magnesium component" unless specified otherwise), or an aluminum or aluminum alloy component (hereinafter collectively referred to as "aluminum component" unless specified otherwise). The present invention also relates to a method for treating a surface of a metallic component using the solution. The present invention further relates to a metallic component prepared by the method.

BACKGROUND OF THE INVENTION

Metallic components are used in a variety of industrial products. In particular, magnesium and aluminum components, which are lightweight and exhibit high specific strength, excellent machinability, and high recyclability, are widely used as parts for automobiles, electric appliances such as mobile phones and personal computers, and aircrafts. In general, protective layers are formed on surfaces of the metallic components for the purpose of corrosion control and improvements in coating adhesion. In recent years, communication trouble and adverse effects on humans caused by electromagnetic wave have been problematic. For achieving high electromagnetic wave shielding, protective coatings with low electrical resistance are desired in many cases.

Various methods other than chromate conversion coating have been reported for applying protective coating to surfaces of metallic components such as magnesium components and aluminum components; however, methods using coating solutions containing environmentally hazardous chromium have been avoided. Accordingly, chromium-free treatments have been proposed, examples of which include technologies as disclosed in the following patent literatures.

Japanese Unexamined Patent Application Publication No. 2000-96255 discloses a method for treating a surface of a magnesium-containing metal coated with a low-resistance film, comprising treating the magnesium-containing metal with a high-alkali solution after etching with an acidic and/or weakly alkaline solution; and treating the metal with a chemical conversion solution containing calcium ions, manganese ions, phosphate ions, and an oxidizing agent.

Japanese Unexamined Patent Application Publication No. 2002-12980 discloses a method for producing a magnesium or magnesium alloy component, comprising treating the component with (A) a surface treatment agent containing a phosphate salt and then treating the component with (B) an antirust pretreatment agent.

WO 2003/069024 discloses a magnesium conversion coating composition comprising (a) a source of vanadate anions; (b) a phosphorus-containing material; and (c) a source of nitrate anions, wherein the vanadate anions, phosphorus-containing material, and nitrate anions are dissolved in an aqueous solution, and the pH of the composition is between 1 and 4.

WO 2002/028550 discloses a method of imparting corrosion resistance to a surface of an aluminum substrate, the method comprising bringing the surface of the aluminum substrate into contact with a treating solution containing water and the following components (A) and (B):

(A) 0.1 to 20 mM/kg of a fluorinated compound selected from the group consisting of tetrafluoroboric acid, a partially or completely neutralized water-soluble tetrafluoroborate, hexafluorosilicic acid, a partially or completely neutralized water-soluble hexafluorosilicate, hexafluorotitanic acid, a partially or completely neutralized water-soluble hexafluorotitanate, hexafluorozirconium acid, a partially or completely neutralized water-soluble hexafluorozirconate, hexafluorohafnium acid, a partially or completely nelized water-soluble hexafluorohafnate, and a mixture thereof (the concentration of the salt in the solution being stoichiometrically equivalent to the concentration of the corresponding acid); and (B) 0.40 to 95 mM/kg of vanadate anions stoichiometrically equivalent to vanadium atoms.

WO 2003/078682 discloses a method for applying a coating to a metallic surface, comprising, in sequence, treating a metallic surface with an aqueous surface-treating agent containing (a) a tungstate ion source and (b) a soluble zirconium-containing material; and drying and/or baking the treated metallic surface.

Metallic components prepared by these treatments exhibit comparatively low electrical resistance in some cases but do not exhibit sufficient corrosion resistance. In addition, the metallic materials applicable are limited to either magnesium components or aluminum components in Japanese Unexamined Patent Application Publication Nos. 2000-96255 and 2002-12980, WO 2003/069024, and WO 2002/028550. Furthermore, it is found that when the aqueous surface-treating agent of WO 2003/078682 is applied to magnesium components, the originally intended purposes, i.e. low electrical resistance and high corrosion resistance are not accomplished.

SUMMARY OF THE INVENTION

An object of the present invention is to provide a chromium-free solution that can impart low electrical resistance that can accomplish electromagnetic wave shielding and high corrosion resistance to a surface of a metallic component such as a magnesium component or an aluminum component. Another object of the present invention is to provide a method for treating a surface of a metallic component using the solution.

The inventors have extensively investigated to overcome the above problems and have discovered that metallic components such as magnesium components and aluminum components exhibit low electrical resistance and high corrosion resistance by bringing the metallic components into contact with an acidic chromium-free solution containing a vanadium cation and/or a vanadyl cation, an anion from an organic acid, and an anion from at least one compound selected from the group consisting of oxoacids of nitrogen, sulfur, phosphorus, boron, and chlorine.

The inventors have also discovered that a chromium-free solution containing a compound of at least one metal selected from the group consisting of alkali metals, alkaline earth metals, aluminum, zinc, silver, cobalt, zirconium, titanium, iron, tungsten, copper, nickel, manganese, and molybdenum; and/or containing an anion from at least one compound selected from the group consisting of fluorinated compounds of boron, silicon, zirconium, titanium, and hafnium, and fluorides; and/or containing at least one compound selected from the group consisting of amines; alcohols; and surfactants can further reduce electrical resistance and improve corrosion resistance.

The inventors have also discovered that adhesiveness and uniformity of appearance of the protective coating having low electrical resistance can be improved by bringing metallic components into contact with a cleaning solution, an activating solution, and a surface conditioning solution before the metallic components are brought into contact with the chromium-free solution.

The present invention enables the metallic components such as magnesium components and aluminum components to exhibit low electrical resistance and high corrosion resistance, i.e., excellent electromagnetic wave shielding and high corrosion resistance, without the use of hazardous chromium. In conventional chromium-free approaches, high corrosion resistance has never been readily compatible with low electrical resistance. The present invention is an innovative approach that can entirely solve this problem. Furthermore, existing facilities that have been used for chromate conversion coating can be used without modification. The present invention therefore has advantages of high productivity and cost saving.

As described above, the present invention, which can solve the problems inherent in related art, will be used in a wide range of fields that require metallic components having electromagnetic wave shielding effect and corrosion resistance hereafter.

DESCRIPTION OF THE PREFERRED EMBODIMENTS

According to an embodiment of the present invention, a chromium-free acidic solution for treating a metal surface contains:

(1) a vanadium cation and/or a vanadyl cation;

(2) an anion from an organic acid; and (3) an anion from at least one compound selected from the group consisting of oxoacids of nitrogen, oxoacids of sulfur, oxoacids of phosphorus, oxoacids of boron, and oxoacids of chlorine.

In a preferred embodiment, the chromium-free solution is provided in the form of aqueous solution.

The types of target metals to be treated with the chromium-free solution according to the present invention are not particularly limited. Examples of such metals include magnesium, aluminum, zinc, iron, and alloys thereof. Among these, the present invention typically applies to magnesium, aluminum, and alloys thereof.

Also, the shape of the target metallic component to be treated with the chromium-free solution according to the present invention is not particularly limited. The metallic component having any shape may be used.

Among the ion components contained in the chromium-free solution according to the present invention, the vanadium cation and the vanadyl cation are basic components for imparting low electrical resistance and high corrosion resistance to metallic components. Among these preferred are vanadyl cations ($VO^{2+}$) and vanadium cations ($V^{4+}$) having the oxidation number of vanadium of 4. Examples of the cation sources include various inorganic or organic vanadium compounds. Non-limiting examples of such inorganic or organic vanadium compounds include vanadium fluorides ($VF_2$, $VF_3$, $VF_4$, and $VF_5$), vanadium chlorides ($VCl_2$, $VCl_3$, and $VCl_4$), vanadyl chloride ($VOCl_2$), vanadium bromides ($VBr_2$ and $VBr_3$), vanadium iodides ($VI_2$ and $VI_3$), vanadium sulfates ($VSO_4$ and $V_2(SO_4)_3$), vanadyl sulfate ($VOSO_4$), vanadium nitrates ($V(NO_3)_2$ and $V(NO_3)_3$), vanadium phosphates ($V_3(PO_4)_2$ and $VPO_4$), and vanadium acetates ($V(CH_3COO)_2$ and $V(CH_3COO)_3$).

These cation sources are added to the chromium-free solution in a concentration sufficient to achieve desired effects. Although the concentration is not particularly limited, the cation sources are added to the chromium-free solution in a total concentration of generally 0.01 to 45 g/L and preferably 0.1 to 15 g/L based on the solution. A lower concentration may not achieve sufficient effects, whereas a higher concentration may cause economic loss due to excess treatment.

On the other hand, vanadate anions such as $VO_3^-$, $VO_4^{3-}$, and $V_2O_7^{4-}$, which are supplied from anion sources such as vanadium pentoxide, vanadic acid, and salts thereof are poorly soluble and tend to form a thin protective layer. Therefore, low electrical resistance is not readily compatible with corrosion resistance.

Also, among the ion components contained in the chromium-free solution according to the present invention, anions from organic acids are believed to secondarily impart corrosion resistance to metallic components. The vanadium cations and vanadyl cations cannot achieve sufficient effects alone. The organic acids as anion sources include various carboxylic compounds (RCOOH where R represents an organic group) and sulfonic compounds ($RSO_3H$ where R represents an organic group). Nonlimiting examples of such carboxylic and sulfonic compounds include formic acid, acetic acid, propionic acid, gluconic acid, butyric acid, oxalic acid, malonic acid, succinic acid, glutaric acid, adipic acid, maleic acid, fumaric acid, benzoic acid, phthalic acid, tartaric acid, glycolic acid, diglycolic acid, lactic acid, glycine, citric acid, malic acid, ethylenediaminetetraacetic acid, nitrilotriacetic acid, methanesulfonic acid, toluenesulfonic acid, benzenesulfonic acid, and salts thereof.

The organic acids as anion sources are added to the chromium-free solution in a concentration sufficient to achieve desired effects. Although the concentration is not particularly limited, the organic acids as anion sources are added to the chromium-free solution in a total concentration of generally 0.01 to 30 g/L and preferably 0.05 to 10 g/L based on the solution to achieve higher effects.

Also, among the ion components contained in the chromium-free solution according to the present invention, anions from oxoacids of nitrogen, sulfur, phosphorus, boron, and chlorine are believed to contribute to ready formation of uniform coating. These anion sources are preferably in the form of acids, salts with alkali metals (Li, Na, and K), salts with alkaline earth metals (Be, Mg, Ca, Sr, and Ba), and ammonium salts. Other metal salts may also be used.

Examples of the preferred oxoacids of nitrogen as anion sources include nitric acid, nitrous acid, hyponitrous acid, and salts thereof. Examples of the preferred oxoacids of sulfur as anion sources include sulfuric acid, sulfurous acid, disulfuric acid, disulfurous acid, dithionous acid, thiosulfuric acid, dithionic acid, polythionic acid, peroxomonosulfuric acid, peroxodisulfuric acid, and salts thereof. Examples of the preferred oxoacids of phosphorus as anion sources include phosphoric acid, phosphorous acid, hypophosphorous acid, pyrophosphoric acid, and salts thereof. Examples of the preferred oxoacids of boron as anion sources include boric acid, perboric acid, and salts thereof. Examples of the preferred oxoacids of chlorine as anion sources include perchloric acid, chloric acid, chlorous acid, hypochlorous acid, and salts thereof.

These anion sources are added to the chromium-free solution in a concentration sufficient to achieve desired effects. Although the concentration is not particularly limited, the anion sources are added to the chromium-free solution in a total concentration of generally 0.1 to 150 g/L and preferably 1 to 70 g/L based on the solution to achieve higher effects.

From the viewpoint of forming a uniform protective layer having a desired thickness on a metallic component, the chromium-free solution according to the present invention is desirably acidic, and preferably has a pH of 0.5 to 6.5, and more preferably a pH of 1 to 5.5.

In a preferred embodiment, the chromium-free solution described above can contain a compound of at least one metal selected from the group consisting of alkali metals (Li, Na, and K), alkaline earth metals (Be, Mg, Ca, Sr, and Ba), aluminum, zinc, silver, cobalt, zirconium, titanium, iron, tungsten, copper, nickel, manganese, and molybdenum. Such metal compounds can improve corrosion resistance and appearance of the protective film. Examples of such metal compounds include, but not limited to, oxides, hydroxides, chlorides, sulfates, nitrates, borates, carbonates, salts with oxoacids, and salts with organic acids.

The metal compound is added to the chromium-free solution in a concentration sufficient to achieve desired effects. Although the concentration is not particularly limited, the chromium-free solution desirably contains effective amounts, i.e., 1 to 150 g/L and preferably 5 to 80 g/L in total of alkali metal and alkaline earth metal compounds. The chromium-free solution desirably contains 0.05 to 50 g/L and preferably 0.1 to 30 g/L in total of other metal compounds. A lower concentration may not obtain sufficient effects, whereas a higher concentration may cause economic loss due to excess treatment.

In another preferred embodiment, the chromium-free solution described above can contain at least one anion selected from the group consisting of anions from fluorinated compounds of boron, silicon, zirconium, titanium, and hafnium; and fluorides. Such anions can improve uniformity and corrosion resistance of coated films. Examples of such anion sources include, but not limited to; acids such as fluoroboric acid, fluorosilicic acid, fluorozirconic acid, fluorotitanic acid, fluorohafnic acid, and hydrofluoric acid, and salts thereof. Non-limiting examples of such salts include salts with alkali metals (Li, Na, and K) and alkaline earth metals (Be, Mg, Ca, Sr, and Ba) and ammonium salts. Other metallic salts may, also be used.

The anion source is added to the chromium-free solution in a concentration sufficient to achieve desired effects. Although the concentration is not particularly limited, the chromium-free solution desirably contains the ion sources in effective amounts, i.e., a total concentration of generally 0.01 to 35 g/L and preferably 0.1 to 20 g/L.

In another preferred embodiment, the chromium-free solution may contain at least one compound selected from the group consisting of amines; alcohols; and surfactants. Such compounds can improve corrosion resistance and appearance of the protective film. The compound is added to the chromium-free solution in a concentration sufficient to achieve desired effects. Although the concentration is not particularly limited, the chromium-free solution desirably contains the compound in an effective amount, i.e., a total concentration of generally 0.001 to 50 g/L and preferably 0.01 to 10 g/L. A lower concentration may not achieve sufficient effects, whereas a higher concentration may cause economic loss due to excess treatment.

Examples of the preferred amines include, but are not limited to, aliphatic or aromatic amines having at least one amino group, ammonium salts thereof, (poly)alkylene polyamines, and alkanolamines. Specific examples of such amines include primary, secondary, and tertiary amines such as methylamine, ethylamine, propylamine, isopropylamine, butylamine, isobutylamine, pentylamine, isopentylamine, hexylamine, dimethylamine, dipropylamine, diisopropylamine, N-methylethylamine, N-ethylisopropylamine, N,N-dimethylpropylamine, and trimethylamine; ammonium salts such as tetramethylammonium chloride, tetramethylammonium hydroxide, tetraethylammonium chloride, and tetraethylammonium hydroxide; (poly)alkylene polyamines such as ethylenediamine, propylenediamine, trimethylenediamine, tetramethylenediamine, pentamethylenediamine, hexamethylenediamine, diethylenetriamine, triethylenetetramine, and tetraethylenepentamine; alkanolamines such as monoethanolamine, diethanolamine, triethanolamine, 2-amino-1-butanol, ethylmonoethanolamine, dimethylethanolamine, diethylethanolamine, dibutylethanolamine, and butyldiethanolamine; aromatic amines such as choline, aniline, toluidine, methylaniline, diphenylamine, and phenylenediamine.

Examples of the preferred alcohols include, but are not limited to, aliphatic or aromatic monohydric, dihydric, trihydric alcohols, and polyhydric alcohols having at least one hydroxyl group. Specific examples of such alcohols include aliphatic or aromatic monohydric alcohols such as methyl alcohol, ethyl alcohol, n-propyl alcohol, isopropyl alcohol, n-butyl alcohol, allyl alcohol, propargyl alcohol, benzyl alcohol, phenol, and cresol; aliphatic or aromatic dihydric alcohols such as ethylene glycol, polyethylene glycol, propylene glycol, 1,2-pentanediol, 3-butene-1,2-diol, 2-butyne-1,4-diol, and catechol; aliphatic or aromatic trihydric alcohols such as glycerin and pyrogallol; and aliphatic polyhydric alcohols such as erythritol, adonitol, D-mannitol, and D-sorbitol.

The surfactants include various surfactants such as nonionic surfactants, cationic surfactants, anionic surfactants, and amphoteric surfactants. Preferred surfactants are nonionic surfactants and anionic surfactants. Particularly preferred surfactants are poly(oxyethylene) alkyl ether, poly (oxyethylene) octylphenyl ether, polyoxyethylene-polyoxypropylene copolymer, aromatic sulfonic acid/formaldehyde condensate, phenol-sulfonic acid/formaldehyde condensate, and naphthalene-sulfonic acid/formaldehyde condensate. These surfactants are commercially available under the trade name of Adeka Tol and Adeka Pluronic (produced by Adeka Corporation); Nonion (produced by NOF Corporation); and Emulgen and Demol (produced by Kao Corporation).

In another preferred embodiment, a method for treating a surface of a metallic component comprises bringing the surface of the metallic component into contact with the chromium-free solution according to the present invention.

The temperature of the chromium-free solution preferably ranges from 10° C. to 80° C. and more preferably from 20° C. to 70° C.

The treating time preferably ranges from 5 seconds to 30 minutes and more preferably from 10 seconds to 10 minutes. A shorter time may not achieve sufficient effects, whereas a longer time may cause trouble due to excess treatment and cost increase.

In a preferred embodiment, the metallic component is brought into contact with the chromium-free solution after the metallic component is brought into contact with a cleaning solution, or after the metallic component is brought into sequential contact with a cleaning solution and an activating solution, or after the metallic component is brought into sequential contact with a cleaning solution, an activating solution, and a surface conditioning solution. This procedure increases the amount of vanadium deposited, enhances the adhesiveness of the protective coating having low electrical resistance, and improves the uniformity of appearance of the protective coating. The cleaning solution removes contamination on the surface of the metallic component, and the activating solution removes the remaining contamination and reaction inhibitors in the post-treatment. The surface conditioning solution is used to remove chips of the metallic component, which are generated during the treatment with the activating solution.

Any cleaning solution known by persons skilled in the art may be used to remove contamination on the metal surface. It is effective that the cleaning solution contains at least one anion or compound selected from the group consisting of surfactants; anions from organic acids, oxoacids of phosphorus, oxoacids of boron, and fluorides; amines; and alcohols.

In a cleaning solution containing surfactants, the total concentration of the surfactants preferably ranges from 0.001 to 50 g/L and more preferably from 0.01 to 10 g/L. In a cleaning solution containing anions from an organic acid; another anions from an oxoacid of phosphorus, an oxoacid of boron, and/or a fluoride; an amine; and/or an alcohol, the total concentration of these compounds or anion sources preferably ranges from 0.01 to 350 g/L and more preferably from 0.1 to 200 g/L.

Also, the temperature of the cleaning solution preferably ranges from 10° C. to 90° C. and more preferably from 30° C. to 70° C. The treating time preferably ranges from 10 seconds to 30 minutes and more preferably from 30 seconds to 10 minutes.

The pH of the cleaning solution may be appropriately selected depending on the type of metal.

Any activating solution known by persons skilled in the art may be used to remove materials that inhibit the formation of a protective layer on the metal surface. It is effective that the activating solution contains at least one anion selected from the group consisting of anions from organic acids, oxoacids of nitrogen, oxoacids of sulfur, oxoacids of phosphorus, oxoacids of boron, oxoacids of chlorine, and fluorides; amines; and surfactants.

In an activating solution containing anions from an organic acid and another anions from an oxoacid of nitrogen, an oxoacid of sulfur, and/or a fluoride, the total concentration of these anion sources preferably ranges from 0.1 to 600 g/L and more preferably from 1 to 300 g/L. In an activating solution containing anions from an oxoacid of phosphorus, an oxoacid of boron, and/or an oxoacid of chlorine, the total concentration of these anion sources preferably ranges from 10 to 850 g/L and more preferably from 25 to 700 g/L. In an activating solution containing an amine and/or a surfactant, the total concentration of these compounds preferably ranges from 0.01 to 100 g/L and more preferably from 0.1 to 30 g/L.

The activating solution is desirably acidic, preferably has a pH of 6.0 or lower, and more preferably a pH of 4.5 or lower.

The temperature of the activating solution preferably ranges from 10° C. to 80° C. and more preferably from 20° C. to 60° C. The treating time preferably ranges from 10 seconds to 30 minutes and more preferably from 30 seconds to 10 minutes.

Any surface conditioning solution known by persons skilled in the art may be used to remove chips remaining on the metal surface. It is effective that the surface conditioning solution contains a hydroxyl anion and at least one anion selected from the group consisting of anions from organic acids, oxoacids of nitrogen, oxoacids of phosphorus, oxoacids of boron, and oxoacids of chlorine; amines; surfactants; and alcohols. The hydroxyl anion source can be any one of hydroxides of alkali metals (lithium, sodium, and potassium), hydroxides of alkaline earth metals (beryllium, magnesium, calcium, strontium, and barium), hydroxides of metallic elements belonging to groups 3 to 11 in the periodic table (for example, manganese hydroxide), and hydroxides of elements belonging to groups 12 to 16 in the periodic table (for example, ammonium hydroxide). Although the hydroxyl anion sources are not particularly limited, water-soluble hydroxyl anion sources are preferred.

In a surface conditioning solution containing a hydroxyl anion, the total concentration of the anion source preferably ranges from 3 to 600 g/L and more preferably from 50 to 500 g/L. In a surface conditioning solution containing anions from an organic acid; another anions from an oxoacid of nitrogen, an oxoacid of phosphorus, an oxoacid of boron, and an oxoacid of chlorine; an amine; a surfactant; and/or alcohols, the total concentration of these compounds or anion sources preferably ranges from 0.01 to 100 g/L and more preferably from 0.1 to 50 g/L.

The surface conditioning solution preferably has a pH of 11 or above and more preferably a pH of 13 or above.

The temperature of the surface conditioning solution preferably ranges from 20° C. to 95° C. and more preferably from 50° C. to 90° C. The treating time preferably ranges from 10 seconds to 30 minutes and more preferably from 20 seconds to 10 minutes.

Surfactants; anions from organic acids, oxoacids of phosphorus, boron, chlorine, nitrogen, and sulfur, and fluorides; amines; and alcohols, all of which are used in the cleaning solution, activating solution, and surface conditioning solution, are the same as defined in the chromium-free solution according to the present invention.

In the present invention, although methods for bringing a metallic component into contact with the chromium-free solution, cleaning solution, activating solution, and surface conditioning solution are not particularly limited, spraying, applying, and dipping method are preferred. Dipping method is more preferred. Dipping with shaking or stirring is most preferred.

Preferably 0.01 to 1.5 g/m$^2$ and more preferably 0.05 to 1.1 g/m$^2$ of vanadium is deposited to a surface of a metallic component through the method of the present invention. A lower vanadium density may lead to insufficient corrosion resistance, whereas a higher density may cause low adhesiveness of coated films to the surface of the metallic component and low electrical resistance.

In still another preferred embodiment, a metallic component is obtained by the method according to the present invention. The metallic component can be used as parts for various industrial products such as automobiles; electric appliances, e.g. mobile phones and personal computers; and aircrafts. The metallic component is particularly preferred for applications that require both high electromagnetic wave shielding and high corrosion resistance.

EXAMPLES

Examples of the present invention will now be described below. The present invention should, however, not be limited to the Examples.

Generic Procedures

Test pieces having a size of 30 mm by 30 mm by 0.5 mm were prepared from a magnesium alloy (ASTM AZ91D equivalent to JIS MD1D) or an aluminum alloy (JIS ADC12). After an appropriate pretreatment such as degreasing, the test pieces were each subjected to the treatment according to the present invention or an alternative treatment for comparison to prepare a metallic component.

The corrosion resistance of the test piece was evaluated by a salt spray test according to JIS Z 2371.

The electrical resistance of the test piece was measured with a low resistivity meter Loresta-EP (manufactured by Mitsubishi Chemical Co., Ltd.) by a two-probe method.

The amount of vanadium deposited on the test piece was measured with an energy-dispersive fluorescent X-ray analyzer (JSX-3600M manufactured by JEOL DATUM LTD.).

Example 1

A test piece of a magnesium alloy was immersed in a chromium-free solution containing 25 g/L of vanadyl sulfate, 3 g/L of malic acid, and 15 g/L of boric acid and having a pH of 2.0 at 25° C. for 1 minute with mild stirring. The resulting test piece was dried in a drying oven at 60° C. to 80° C. for 5 minutes to prepare a metallic component.

Example 2

A metallic component was prepared as in Example 1 except that 30 g/L of manganese sulfate was further added to the chromium-free solution used in Example 1.

Example 3

A metallic component was prepared as in Example 1 except that 20 g/L of ammonium fluorotitanate was further added to the chromium-free solution used in Example 2.

Example 4

A metallic component was prepared as in Example 1 except that 0.1 g/L of triethanolamine was further added to the chromium-free solution used in Example 3.

Example 5

A metallic component was prepared as in Example 1 except that 29 g/L of glycerin was further added to the chromium-free solution used in Example 4.

Example 6

A metallic component was prepared as in Example 1 except that 1 g/L of Emulgen 810 (trade name, a surfactant produced by Kao Corporation, poly(oxyethylene) octylphenyl ether) was further added to the chromium-free solution used in Example 5.

Example 7

A test piece of a magnesium alloy was immersed in a chromium-free solution containing 13 g/L of vanadium fluoride, 32 g/L of vanadyl sulfate, 0.05 g/L of oxalic acid, and 1.2 g/L of sodium perchlorate and having a pH of 3.0 at 20° C. for 1 minute with mild stirring. The resulting test piece was dried in a drying oven at 60° C. to 80° C. for 5 minutes to prepare a metallic component.

Example 8

A metallic component was prepared as in Example 7 except that 0.1 g/L of ammonium molybdate was further added to the chromium-free solution used in Example 7.

Example 9

A metallic component was prepared as in Example 7 except that 0.1 g/L of ammonium fluorozirconate was further added to the chromium-free solution used in Example 8.

Example 10

A test piece of a magnesium alloy was immersed in a chromium-free solution containing 5 g/L of vanadyl sulfate, 1 g/L of glycine, 70 g/L of phosphoric acid, and 10 g/L of ammonium fluorotitanate and having a pH of 1.0 at 25° C. for 10 seconds with mild stirring. The resulting test piece was dried in a drying oven at 60° C. to 80° C. for 5 minutes to prepare a metallic component.

Example 11

A test piece of an aluminum alloy was immersed in a chromium-free solution containing 10 g/L of vanadyl sulfate, 2 g/L of potassium tartrate, and 2 g/L of sodium nitrate and having a pH of 4.0 at 40° C. for 10 minutes with mild stirring. The resulting test piece was dried in a drying oven at 60° C. to 80° C. for 5 minutes to prepare a metallic component.

Example 12

A metallic component was prepared as in Example 11 except that 7 g/L of zinc sulfate was further added to the chromium-free solution used in Example 11.

Example 13

A metallic component was prepared as in Example 11 except that 1 g/L of ammonium fluorozirconate and 0.2 g/L of potassium borofluoride were further added to the chromium-free solution used in Example 12.

Example 14

A metallic component was prepared as in Example 11 except that 0.1 g/L of monoethanolamine was further added to the chromium-free solution used in Example 13.

Example 15

A metallic component was prepared as in Example 11 except that 1 g/L of propylene glycol was further added to the chromium-free solution used in Example 14.

Example 16

A metallic component was prepared as in Example 11 except that 0.1 g/L of Demol N (trade name, a surfactant produced by Kao Corporation, sodium salt of β-naphthalene sulfonic acid/formaldehyde condensate) was further added to the chromium-free solution used in Example 15.

Example 17

A test piece of an aluminum alloy was immersed in a chromium-free solution containing 8 g/L of vanadyl sulfate, 3 g/L of lactic acid, 2 g/L of sodium nitrate, 10 g/L of zinc sulfate, 15 g/L of manganese sulfate, and 3 g/L of ammonium fluorozirconate and having a pH of 5.5 at 70° C. for 5 minutes with mild stirring. The resulting test piece was dried in a drying oven at 60° C. to 80° C. for 5 minutes to prepare a metallic component.

Example 18

A test piece of a magnesium alloy was immersed in a cleaning solution containing 0.1 g/L of Nonion P-210 (trade name, a surfactant produced by NOF Corporation, polyoxyethylene cetyl ether) and 28 g/L of sodium borate at 60° C. for 5 minutes. The test piece was then immersed in a chromium-free solution containing 18 g/L of vanadyl sulfate, 8.5 g/L of methanesulfonic acid, 35 g/L of ammonium nitrate, 1.5 g/L of calcium gluconate, and 0.1 g/L of Adeka Pluronic L (trade name, a surfactant produced by Adeka Corporation, polyoxyethylene-polyoxypropylene condensate) and having a pH of 2.5 at 25° C. for 3 minutes with mild stirring. The resulting test piece was dried in a drying oven at 60° C. to 80° C. for 5 minutes to prepare a metallic component.

Example 19

A test piece of a magnesium alloy was immersed in a cleaning solution containing 0.1 g/L of Nonion P-210 (trade name, a surfactant produced by NOF Corporation, polyoxyethylene cetylether) and 50 g/L of sodium phosphate at 60° C. for 5 minutes. The test piece was then immersed in an activating solution containing 10 g/L of oxalic acid and 0.1 g/L of Emulgen L-40 (trade name, a surfactant produced by Kao Corporation, polyoxyethylene derivative) and having a pH of 2.0 at 40° C. for 30 seconds. The test piece was then immersed in a chromium-free solution containing 18 g/L of vanadyl sulfate, 3 g/L of p-toluenesulfonic acid, 10 g/L of sodium chlorate, 0.5 g/L of calcium phosphate, and 0.1 g/L of Adeka Pluronic L (trade name, a surfactant produced by Adeka Corporation, polyoxyethylene-polyoxypropylene condensate) and having a pH of 2.5 at 25° C. for 3 minutes with mild stirring. The resulting test piece was dried in a drying oven at 60° C. to 80° C. for 5 minutes to prepare a metallic component.

Example 20

A metallic component was prepared as in Example 19 except that a test piece was immersed in the activating solution used in Example 19 and was then immersed in a surface conditioning solution of sodium hydroxide of 125 g/L at 80° C. for 1 minute before the treatment in the chromium-free solution.

Example 21

A test piece of an aluminum alloy was immersed in a cleaning solution containing 1 g/L of Nonion P-210 (trade name, a surfactant produced by NOF Corporation, polyoxyethylene cetylether), 3 g/L of citric acid, 5 g/L of phosphorus, and 1 g/L of ammonium hydrogen fluoride at 40° C. for 5 minutes. The test piece was then immersed in a chromium-free solution containing 2 g/L of vanadyl sulfate, 0.5 g/L of malic acid, 35 g/L of sodium nitrate, 3 g/L of ammonium fluorozirconate, and 3.5 g/L of zinc sulfate and having a pH of 5.0 at 25° C. for 10 minutes with mild stirring. The resulting test piece was dried in a drying oven at 60° C. to 80° C. for 5 minutes to prepare a metallic component.

Example 22

A metallic component was prepared as in Example 21 except that a test piece was immersed in the cleaning solution used in Example 21 and was then immersed in an activating solution containing 500 g/L of phosphoric acid and 50 g/L of ammonium hydrogen fluoride and having a pH of 0.5 or lower at 20° C. for 30 seconds before the treatment in the chromium-free solution.

Comparative Example 1

A test piece of a magnesium alloy was immersed in an aqueous solution containing 100 g/L of ammonium dihydrogen phosphate and 20 g/L of potassium permanganate and having a pH of 3.5 that was adjusted by phosphoric acid at 40° C. for 5 minutes with mild stirring. The resulting test piece was dried in a drying oven at 60° C. to 80° C. for 5 minutes to prepare a metallic component. This Comparative Example corresponds to the treatment disclosed in Japanese Unexamined Patent Application Publication No. 2002-12980.

Comparative Example 2

The test piece prepared in Comparative Example 1 was immersed in an aqueous solution containing 1.5% by weight of m-toluic acid, 1.5% by weight of 3-mercapto-1,2,4-triazole, 1.5% by weight of isopropanolanaine at room temperature for 1 minute with mild stirring. The resulting test piece was dried in a drying oven at 60° C. to 80° C. for 5 minutes to prepare a metallic component. This Comparative Example corresponds to the treatment disclosed in Japanese. Unexamined Patent Application Publication No. 2002-12980.

Comparative Example 3

A test piece of a magnesium alloy was immersed in an aqueous solution containing 15.2 g/L of calcium nitrate tetrahydrate, 2.1 g/L of manganese carbonate, 25.6 g/L of phosphoric acid, and 0.4 g/L of sodium chlorate and having a pH of 1.7 at 70° C. for 5 minutes with mild stirring. The resulting test piece was dried in a drying oven at 60° C. to 80° C. for 5 minutes to prepare a metallic component. This Comparative Example corresponds to the treatment disclosed in Japanese Unexamined Patent Application Publication No. 2000-96255.

Comparative Example 4

A test piece of a magnesium alloy was immersed in an aqueous solution containing 20 g/L of ammonium vanadate, 20 g/L of sodium borofluoride, 10 g/L of fluorosilicic acid, 100 g/L of sodium phosphite, 100 g/L of nitric acid, and 20 g/L of triethanolamine and having a pH of 2.0 at 23° C. for 5 minutes with mild stirring. The resulting test piece was dried in a drying oven at 60° C. to 80° C. for 5 minutes to prepare a metallic component. This Comparative Example corresponds to the treatment disclosed in WO 2003/069024.

Comparative Example 5

A test piece of an aluminum alloy was immersed in an aqueous solution containing 0.5 g/L of ammonium vanadate and 0.2 g/L of ammonium fluorozirconate and having a pH of 4.0 that was adjusted by ammonia at 60° C. for 6 minutes with mild stirring. The resulting test piece was dried in a drying oven at 60° C. to 80° C. for 5 minutes to prepare a metallic component. This Comparative Example corresponds to the treatment disclosed in WO 2002/028550.

Comparative Example 6

A test piece of an aluminum alloy was immersed in an aqueous solution containing 1.0 g/L of potassium tungstate and 0.5 g/L of ammonium fluorozirconate and having a pH of 4 at 30° C. for 5 minutes with mild stirring. The resulting test piece was dried in a drying oven at 60° C. to 80° C. for 5 minutes to prepare a metallic component. This Comparative Example corresponds to the treatment disclosed in WO 2003/078682.

Comparative Example 7

A test piece of an aluminum alloy was immersed in an aqueous solution containing 10 g/L of chromic acid anhydride, 4 g/L of phosphoric acid, and 3 g/L of sodium hydrogen fluoride at 40° C. for 60 seconds with mild stirring. The resulting test piece was dried in a drying oven at 60° C. to 80° C. for 5 minutes to prepare a metallic component. This Comparative Example corresponds to the treatment disclosed in (Kaneko Hideaki, "ALUMINIUM no KASEISYORI (Chemical Treatment of Aluminum)", first edition, p. 60, Kallos Publishing Co. Ltd., published on Mar. 18, 2003).

Comparative Example 8

A test piece of a magnesium alloy was immersed in an aqueous solution containing 1 g/L of vanadium sulfate at 25° C. for 1 minute with mild stirring. The resulting test piece was dried in a drying oven at 60° C. to 80° C. for 5 minutes to prepare a metallic component.

The results are shown in Table 1.

TABLE 1

| | Corrosion Resistance | Electrical Resistance | Amount of Vanadium deposited |
|---|---|---|---|
| Example 1 | B | A (0.2 Ω) | A (0.38 g/m$^2$) |
| Example 2 | B | A (0.1 Ω) | A (0.53 g/m$^2$) |
| Example 3 | A | A (0.2 Ω) | A (0.65 g/m$^2$) |
| Example 4 | A | A (0.2 Ω) | A (0.61 g/m$^2$) |
| Example 5 | A | A (0.2 Ω) | A (0.57 g/m$^2$) |
| Example 6 | A | A (0.2 Ω) | A (0.57 g/m$^2$) |
| Example 7 | B | A (0.3 Ω) | A (0.87 g/m$^2$) |
| Example 8 | B | A (0.2 Ω) | A (0.58 g/m$^2$) |
| Example 9 | A | A (0.2 Ω) | A (0.62 g/m$^2$) |
| Example 10 | B | A (<0.1 Ω) | A (0.01 g/m$^2$) |
| Example 11 | B | A (0.1 Ω) | A (0.18 g/m$^2$) |
| Example 12 | B | A (0.2 Ω) | A (0.32 g/m$^2$) |
| Example 13 | A | A (0.2 Ω) | A (0.68 g/m$^2$) |
| Example 14 | A | A (0.2 Ω) | A (0.58 g/m$^2$) |
| Example 15 | A | A (0.2 Ω) | A (0.52 g/m$^2$) |
| Example 16 | A | A (0.2 Ω) | A (0.59 g/m$^2$) |
| Example 17 | A | A (0.3 Ω) | A (0.83 g/m$^2$) |
| Example 18 | A | A (0.3 Ω) | A (1.1 g/m$^2$) |
| Example 19 | A | A (0.3 Ω) | A (0.87 g/m$^2$) |
| Example 20 | A | A (0.3 Ω) | A (0.98 g/m$^2$) |
| Example 21 | B | A (0.1 Ω) | A (0.12 g/m$^2$) |
| Example 22 | B | A (0.1 Ω) | A (0.24 g/m$^2$) |
| Comparative Example 1 | D | B (0.3 Ω ≤ ER < 3.0 Ω) | n/a |
| Comparative Example 2 | C | C (≥3.0 Ω) | n/a |
| Comparative Example 3 | D | B (0.3 Ω ≤ ER < 3.0 Ω) | n/a |
| Comparative Example 4 | D | B (0.3 Ω ≤ ER < 3.0 Ω) | X (<0.01 g/m$^2$) |
| Comparative Example 5 | D | B (0.3 Ω ≤ ER < 3.0 Ω) | X (<0.01 g/m$^2$) |
| Comparative Example 6 | D | C (≥3.0 Ω) | n/a |
| Comparative Example 7 | C | C (≥3.0 Ω) | n/a |
| Comparative Example 8 | D | A (0.1 Ω) | X (<0.01 g/m$^2$) |

<Evaluation Criteria for Corrosion Resistance>

A: No rust was for more than 48 hours

B: No rust was found for 48 hours

C: Rust was found within 24 hours

D: Rust was found within 8 hours

<Evaluation Criteria for Electrical Resistance (ER)>

A: ER<0.3Ω

B: 0.3Ω≤ER<3.0Ω

C: ER≥3.0Ω

<Evaluation Criteria for the Amount of Vanadium Deposited>

A: 0.01 to 1.1 g/m$^2$

X: less than 0.01 g/m$^2$

What is claimed is:

1. A method for treating a surface of a metallic component, comprising:

providing an acidic chromium-free solution comprising:

(1) a tetravalent vanadium cation and/or a vanadyl cation;

(2) an anion from an organic acid selected from the group consisting of malonic acid, succinic acid, glycolic acid, diglycolic acid, ethylenediaminetetraacetic acid, nitrilotriacetic acid, methanesulfonic acid, toluenesulfonic acid, benzenesulfonic acid, and salts thereof;

(3) an anion from at least one compound selected from the group consisting of oxoacids of nitrogen, sulfur, phosphorus, boron, and chlorine; and (4) a compound of at least one metal selected from the group consisting of alkali metals, alkaline earth metals, aluminum, zinc, silver, cobalt, iron, copper, and nickel;

wherein the metal to be treated is magnesium, aluminum, or an alloy thereof; and bringing the metallic component into contact with said chromium-free solution;

wherein said provided solution contains the source of component (1) in a total concentration of 0.01 to 45 g/L based on the solution, the source of component (2) in a total concentration of 0.01 to 30 g/L based on the solution, and the source of component (3) in a total concentration of 1.0 to 150 g/L based on the solution.

2. A method for treating a surface of a metallic component, comprising:

providing an acidic chromium-free solution comprising:

(1) a tetravalent vanadium cation and/or a vanadyl cation;

(2) an anion from an organic acid selected from the group consisting of malonic acid, succinic acid, glycolic acid, diglycolic acid, ethylenediaminetetraacetic acid, nitrilotriacetic acid, methanesulfonic acid, toluenesulfonic acid, benzenesulfonic acid, and salts thereof;

(3) an anion from at least one compound selected from the group consisting of oxoacids of nitrogen, sulfur, phosphorus, boron, and chlorine; and (4) a compound of at least one metal selected from the group consisting of alkali metals, alkaline earth metals, aluminum, zinc, silver, cobalt, iron, copper, and nickel;

wherein the metal to be treated is magnesium, aluminum, or an alloy thereof; and bringing the metallic component into contact with said chromium-free solution, after the metallic component is brought into contact with a cleaning solution, after the metallic component is brought into sequential contact with a cleaning solution, or after the metallic component is brought into sequential contact with a cleaning solution, an activating solution, and a surface conditioning solution;

wherein said provided solution contains the source of component (1) in a total concentration of 0.01 to 45 g/L based on the solution, the source of component (2) in a total concentration of 0.01 to 30 g/L based on the solution, and the source of component (3) in a total concentration of 1.0 to 150 g/L based on the solution.

3. The method according to claim 2, wherein the cleaning solution contains at least one compound selected from the group consisting of surfactants; anion sources comprising organic acids, oxoacids of phosphorus, oxoacids of boron, and fluorides; amines; and alcohols, wherein the activating solution, if used, contains at least one anion selected from the group consisting of anions from organic acids, oxoacids of nitrogen, oxoacids of sulfur, fluorides, oxoacids of phosphorus, oxoacids of boron, and oxoacids of chlorine; amines; and surfactants, and wherein the surface conditioning solution, if used, contains a hydroxyl anion and at least one anion selected from the group consisting of anions from organic acids, oxoacids of nitrogen, oxoacids of phosphorus, oxoacids of boron, and oxoacids of chlorine; amines; surfactants; and alcohols.

4. The method of either of claim 1 or 2 wherein said provided solution further comprises:

at least one anion selected from the group consisting of anions from fluorinated compounds of boron, silicon, zirconium, titanium, and hafnium; and fluorides.

5. The method of either of claim 1 or 2 wherein said provided solution further comprises:

at least one compound selected from the group consisting of amines, alcohols, and surfactants.

* * * * *